US007080985B2

(12) United States Patent
Hopper

(10) Patent No.: US 7,080,985 B2
(45) Date of Patent: Jul. 25, 2006

(54) QUICK RELEASE CONNECTOR ASSEMBLY

(75) Inventor: Michael B. Hopper, 61 Sherbrook Ave., Worcester, MA (US) 01604

(73) Assignee: Michael B. Hopper, Worcester, MA (US)

( * ) Notice: Subject to any disclaimer, the term of this patent is extended or adjusted under 35 U.S.C. 154(b) by 0 days.

(21) Appl. No.: 11/301,154

(22) Filed: Dec. 12, 2005

(65) Prior Publication Data

US 2006/0089038 A1 Apr. 27, 2006

Related U.S. Application Data

(62) Division of application No. 10/918,014, filed on Aug. 13, 2004.

(60) Provisional application No. 60/574,516, filed on May 26, 2004, provisional application No. 60/558,938, filed on Apr. 2, 2004.

(51) Int. Cl.
*H01R 39/00* (2006.01)

(52) U.S. Cl. ..... 439/8; 439/21; 439/31; 439/467; 439/459; 74/5.6 D; 174/86

(58) Field of Classification Search ..... 439/21, 439/6, 8, 31, 467, 459; 74/5.6 D; 174/86
See application file for complete search history.

(56) References Cited

U.S. PATENT DOCUMENTS

| | | | | |
|---|---|---|---|---|
| 760,801 | A | 5/1904 | Nichols | |
| 2,070,196 | A | 2/1937 | Black | |
| 2,462,296 | A | 2/1949 | Yirava | |
| 2,702,674 | A | 2/1955 | Willson et al. | |
| 2,756,945 | A | 7/1956 | Robboy | |
| 3,062,479 | A | 11/1962 | Griffitts | |
| 3,075,724 | A | 1/1963 | Stahmer | |
| 3,093,342 | A | 6/1963 | Krohn | |
| 3,162,395 | A | 12/1964 | Bray | |
| 3,305,103 | A | 2/1967 | Hilstrom | |
| 3,384,321 | A | 5/1968 | Becker et al. | |
| 3,615,065 | A | 10/1971 | Elliott | |
| 4,003,552 | A | 1/1977 | Sobolewski | |
| 4,655,399 | A | 4/1987 | Harvey | |
| 4,743,207 | A * | 5/1988 | Clark | 439/317 |
| 4,897,512 | A | 1/1990 | Johnston | |
| 5,035,640 | A * | 7/1991 | Drogo | 439/321 |
| 5,054,162 | A | 10/1991 | Rogers | |
| 5,662,488 | A * | 9/1997 | Alden | 439/314 |
| 5,785,544 | A * | 7/1998 | Linden et al. | 439/278 |
| 6,065,705 | A | 5/2000 | Schmitt | |
| 6,162,082 | A * | 12/2000 | Karsten et al. | 439/318 |
| 6,386,886 | B1 * | 5/2002 | Filaretos | 439/21 |
| 6,695,620 | B1 * | 2/2004 | Huang | 439/11 |
| 6,814,580 | B1 * | 11/2004 | Li et al. | 439/6 |
| 6,893,267 | B1 * | 5/2005 | Yueh | 439/8 |

* cited by examiner

OTHER PUBLICATIONS

Connector Art (9 Sheets).

*Primary Examiner*—Truc Nguyen
(74) *Attorney, Agent, or Firm*—Sampson & Associates, P.C.

(57) ABSTRACT

A quick release connector is provided. In one embodiment the connector includes an electrical connector including a first component having a first plurality of teeth and a second component having a second plurality of teeth. The first and second pluralities of teeth are configured to selectively engage and disengage one another upon connecting and disconnecting the connector. The engagement of the teeth is operative to substantially prevent relative axial motion between the first and second portions of the connector. Embodiments of this invention may advantageously support axial loads while maintaining a reliable electrical contact. Various alternative embodiments include a gimbal assembly in which electric lines extend through the gimbal, straddling one of the gimbal axles. Such gimbal assemblies may also support axial loads.

8 Claims, 17 Drawing Sheets

QUICK RELEASE CONNECTOR ASSEMBLY

RELATED APPLICATIONS

This application is a divisional of U.S. patent application Ser. No. 10/918,014, filed Aug. 13, 2004, entitled Quick Release Connector Assembly, which claims priority to U.S. Provisional Applications Ser. No. 60/558,938, filed Apr. 2, 2004, entitled Connector, and Ser. No. 60/574,516, filed May 26, 2004, entitled Connector, the contents of which are incorporated herein by reference in their entirety for all purposes.

BACKGROUND

1. Technical Field

This invention relates to a connector, and more particularly to a quick release electrical connector able to support axial loads. This invention further relates to a gimbal assembly having a cord extending therethrough.

2. Background Information

Connectors and gimbal assemblies are used in a wide range of industries, in particular in combination with various hand tools. In numerous applications it is desirable for an electrical connector to support an axial load without disconnecting. Many electrical connectors capable of supporting an axial load are known commercially. However, such connectors typically require secondary action by a user to secure the male and female components of the connector. For example, certain commercial connectors include threaded portions that must be threadably engaged after the male and female portions are coupled. Other commercial connectors include screws or clips that must be manually engaged after the male and female portions are coupled. A standard coaxial cable connector is an example of another commercial connector requiring secondary user action. In such coaxial connectors, a rotatable shroud disposed on the male portion must be rotated after an electrical connection is made to engage tabs on the female portion with slots on the shroud.

Other commercial connectors are known that include tabs or snaps that become engaged when then the connector is fully connected. While such connectors are known to support an axial load and require less user action, they still pose potential problems. For example, such connectors typically include a partially connected state, i.e., a state at which the contacts of the connector are electrically coupled but at which the tabs or snaps are not fully engaged. Moreover, such tabs or snaps are frequently deployed on outer surfaces of the connector and are thus prone to mechanical damage and/or excessive wear, thereby limiting their effectiveness.

The above-described commercial electrical connectors share a common drawback in that a user may neglect to fully secure the male and female portions together, thereby resulting in a compromised electrical connection and/or possibly even causing injury to a user in certain applications. Therefore, there exists a need for improved electrical connectors, in particular an electrical connector that supports axial loads and does not include a partially connected state. Moreover, in certain applications it may be advantageous to utilize such improved connectors with a gimbal assembly, and in particular a gimbal assembly that accommodates an electrical cord extending therethrough. Therefore, there also exists a need for improved gimbal assemblies and improved electrical assemblies including an electrical connector and a gimbal.

SUMMARY OF THE INVENTION

In one aspect the present invention includes a connector having a first portion configured to engage and disengage with a second portion. The first portion includes a first lock deployed, the first lock including a first plurality of teeth formed in an axial surface thereof. The second portion includes a second lock, the second lock including a second plurality of teeth formed in an axial surface thereof, the second lock configured to rotate about a longitudinal axis of the second portion between first and second rotational positions, the second lock biased towards the first rotational position, the second lock in the second rotational position when the connector is connected. The first and second pluralities of teeth are configured to selectively engage and disengage one another upon connecting and disconnecting the connector, the engagement of the teeth operative to substantially prevent relative axial motion between the first and second portions of the connector. The connector further includes a shroud deployed on the first portion substantially coaxially about the first lock, the shroud disposed to displace along a longitudinal axis of the first portion between first and second shroud positions, the shroud biased towards the first shroud position and disposed in the first shroud position when the electrical connector is connected. The shroud substantially prevents the second lock from rotating from the second rotational position to the first rotational position when the electrical connector is connected.

In another aspect this invention includes an electrical connector having one or more first electrical contacts deployed on a first portion of the electrical connector and one or more second electrical contacts deployed on a second portion of the electrical connector. The first portion is configured to engage and disengage with the second portion wherein at least one of the first plurality of electrical contacts electrically couples and decouples with corresponding ones of the second plurality of contacts upon connecting and disconnecting of the electrical connector. The connector further includes a first lock deployed on the first portion about the first plurality of electrical contacts and a second lock deployed on the second portion about the second plurality of electrical contacts. The second lock is configured to rotate about a longitudinal axis of the second portion between first and second rotational positions. The second lock is biased towards the first rotational position and disposed in the second rotational position when the electrical connector is connected. The first and second locks are configured to automatically engage and disengage one another upon connecting and disconnecting of the electrical connector, the engagement of the first and second locks operative to substantially prevent relative axial motion between the first and second portions of the electrical connector. The connector further includes a shroud deployed on the first portion substantially coaxially about the first lock, the shroud disposed to displace along a longitudinal axis of the first portion between first and second shroud positions. The shroud is biased towards the first shroud position and disposed in the first shroud position when the electrical connector is connected. The shroud substantially prevents the second lock from rotating from the second rotational position to the first rotational position when the electrical connector is connected.

In a further aspect this invention includes a gimbal assembly for use with a power tool wherein an electric power cord including first and second electric lines extends through the gimbal assembly. The gimbal assembly includes a gimbal deployed about a receptacle, the gimbal being disposed to rotate about a first axle, the first axle extending through the gimbal and the receptacle. The gimbal and the receptacle disposed to rotate together about a second axle, the second axle substantially orthogonal to the first axle, the second axle supported by an internal housing. The gimbal assembly further includes a wedge deployed in the receptacle, the wedge including first and second wire channels, the first and second wire channels disposed to receive the corresponding first and second electric lines wherein the first and second electric lines bypass the first axle, and a cable jacket deployed about the wedge, so that the cable jacket is secured between the receptacle and the wedge to resist axial movement of the cable.

In yet a further aspect this invention includes an electrical assembly having a first cord including a first connector portion coupled to one end thereof, the first connector portion including a first lock deployed about the first plurality of contacts and a second cord including a second connector portion coupled to one end thereof, the second connector portion including a second lock. The second lock is configured to rotate about a longitudinal axis of the second connector portion between first and second rotational positions and is biased towards the first rotational position. The first and second locks are configured to engage and disengage one another upon connecting and disconnecting of the first and second connector portions, the engagement of the first and second locks operative to substantially prevent axial motion between the first and second connector portions. The assembly further includes a gimbal assembly deployed about one of the first and second cords, the cord extending through the gimbal assembly, the gimbal assembly configured to permit rotation of a device coupled thereto about first and second substantially perpendicular axes. The gimbal assembly includes a wedge deployed in a receptacle, the wedge including at least one channel, the channel disposed to receive a line deployed in the cord.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

The above and other features and advantages of this invention will be more readily apparent from a reading of the following detailed description of various aspects of the invention taken in conjunction with the accompanying drawings, in which.

DETAILED DESCRIPTION

Figure 1:
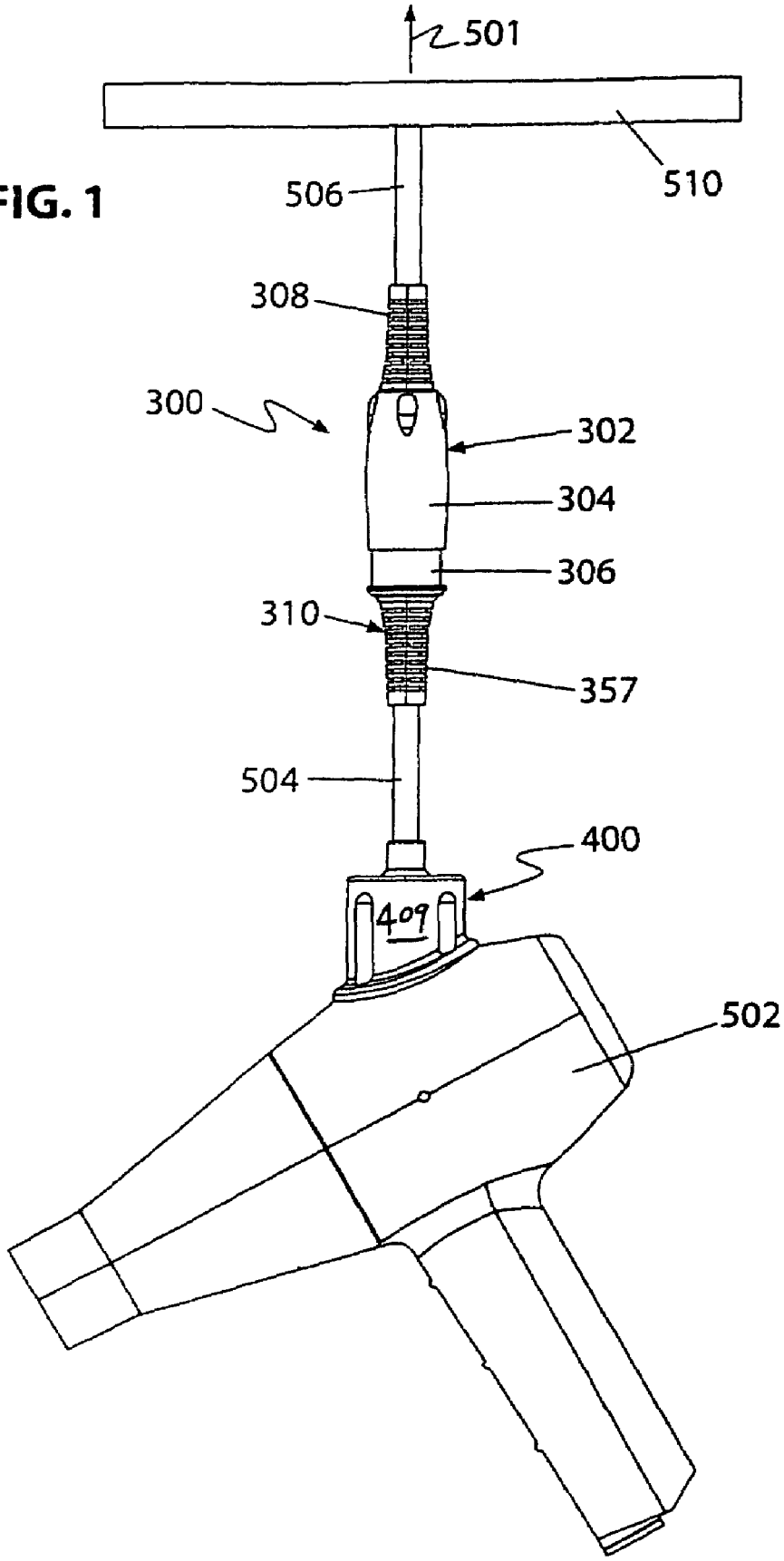
FIG. 1 is a side view of an embodiment of the present invention.
Figure 2:
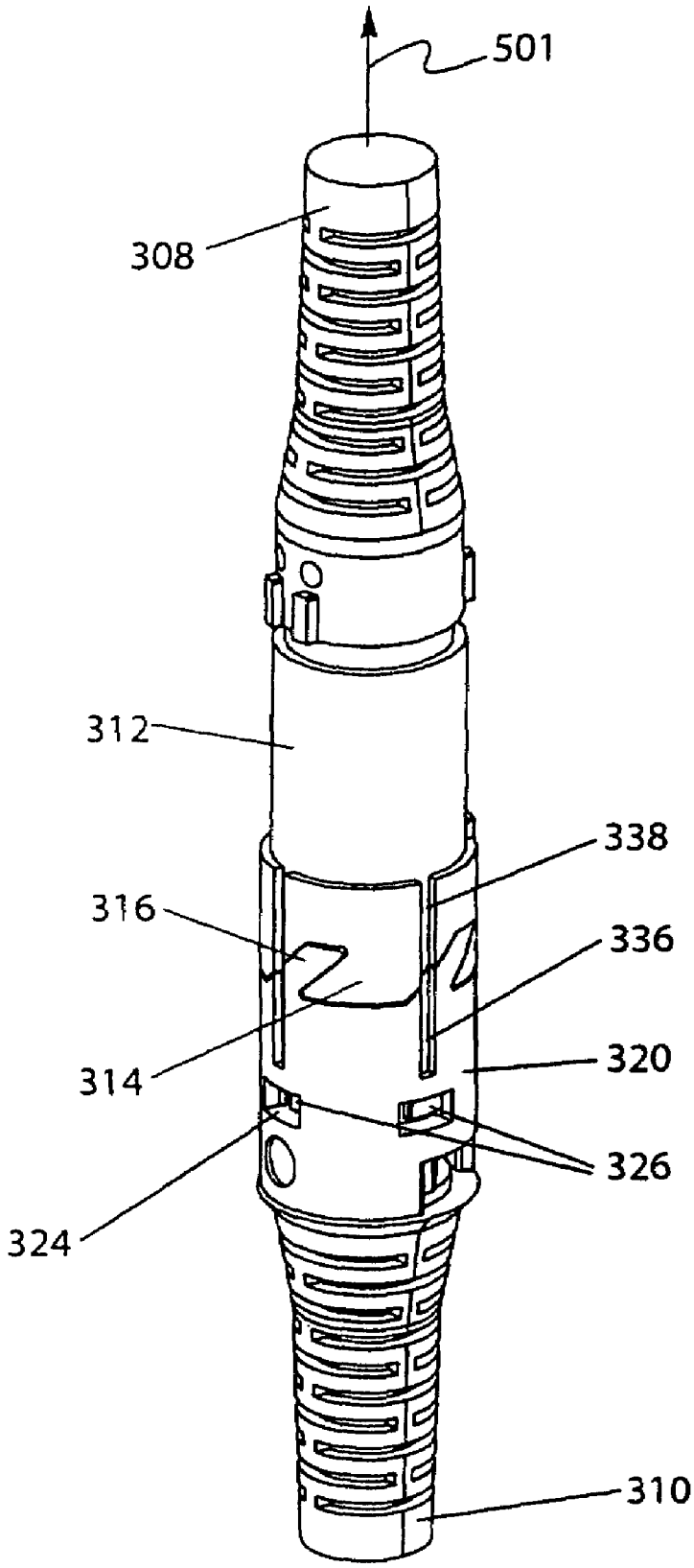
FIG. 2 is a perspective view of the connector assembly of FIG. 1 in a connected state with the shroud portions removed.
Figure 3:
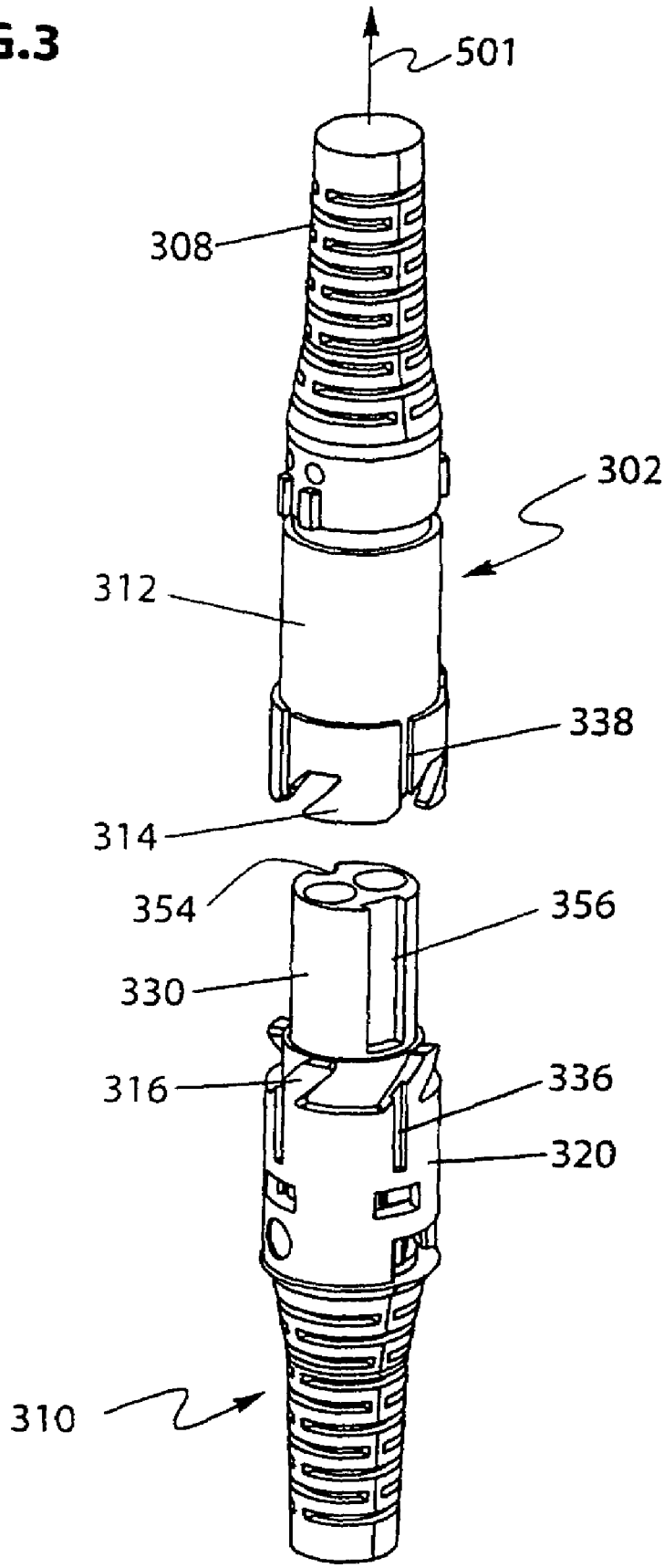
FIG. 3 is a perspective view of a portion of the connector assembly of FIG. 1 in a disconnected state with the shroud portions removed.
Figure 4:
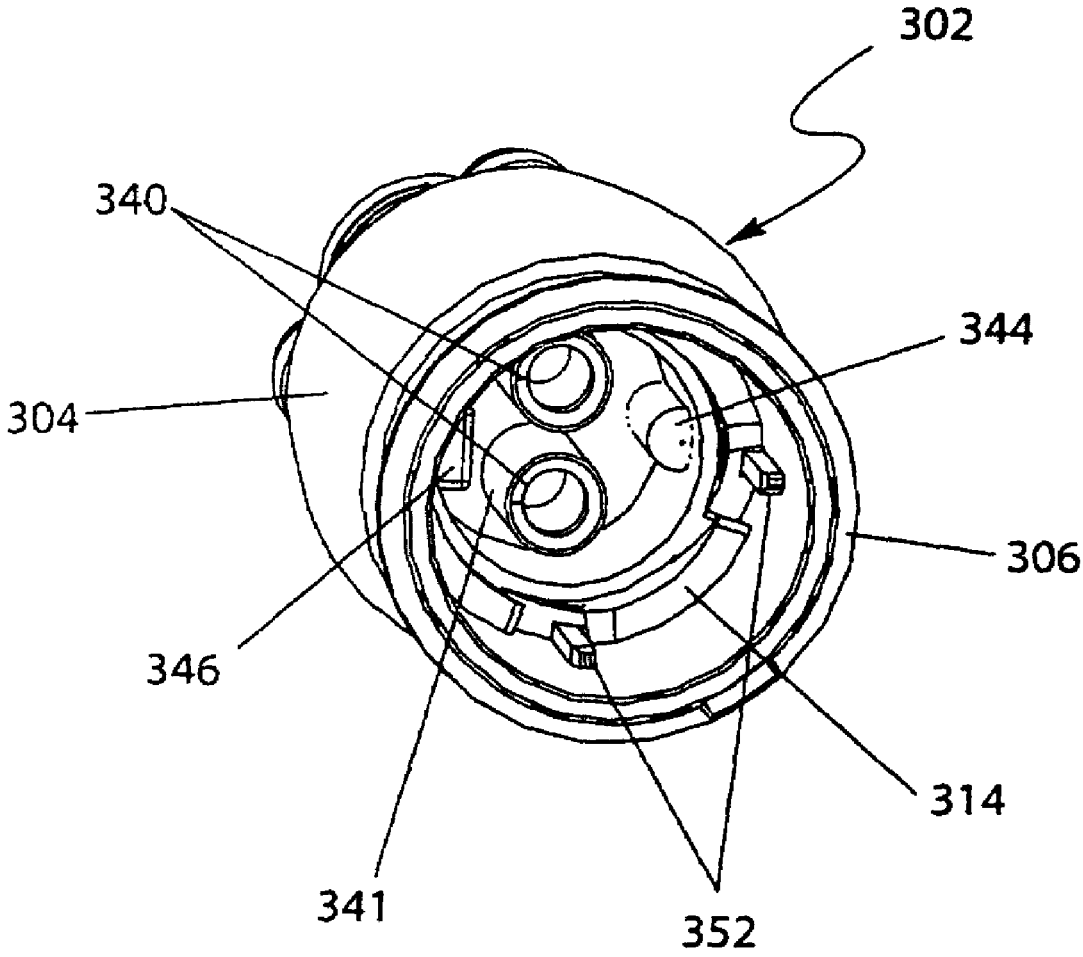
FIG. 4 is a perspective view of an upper portion of the connector assembly of FIG. 1.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings shall be indicated with like reference numerals and similar features as shown in alternate embodiments in the drawings shall be indicated with similar reference numerals.

With reference now to FIG. 1, one exemplary embodiment of a system 500 in accordance with this invention is shown. In this embodiment a tool 502, such as a hair dryer, is shown connected to a support 510. System 500 includes a quick release electrical connector 300 for electrically coupling tool 502 to a power source (e.g., located in support 510) through power cords 504 and 506. System 500 further includes a gimbal assembly 400 that enables the tool 502 to rotate substantially freely about first and second perpendicular axes. Connector 300 includes upper 302 and lower 310 connector portions and is described in more detail below with respect to FIGS. 2 through 8. Gimbal assembly 400 is deployed in gimbal housing 410 and is described in more detail below with respect to FIGS. 9 through 11.

It will be understood that the designations of "upper" and "lower" connector portions are for ease of reference only, and are not intended to be limitations on the invention. The artisan of ordinary skill will of course recognize that the electrical connector assembly may be utilized in substantially any orientation, including orientations in which the upper portion 302 is deployed below the lower portion 310. It will further be understood that although the deployments and embodiments described herein are directed to use with a hair dryer, use of connector 300 according to the present invention is not limited to hair dryer applications such as illustrated on FIG. 1. Embodiments of this invention may be useful in a wide range of applications requiring coupling of data and/or power conduits, especially in applications in which a quick release connector capable of supporting axial loads is advantageous. For example, such connectors may be utilized to support substantially any tool, including those used in assembly line applications. Other useful embodiments may provide, for example, a fluid or pneumatic connector rather than an electrical connector as shown in the Figures.

Exemplary connector embodiments according to this invention provide several technical advantages. Various connector embodiments may support axial loads while advantageously maintaining a reliable electrical contact. Moreover, exemplary connector embodiments may be made watertight, e.g., via the use of O-rings, and may therefore be used in either liquid or gaseous environments. For example, a suitably sized O-ring may be place about each column 341 (FIG. 4), which may then form tight seals between upper and lower portions 302 and 310 upon mutual engagement as discussed below. Various tools (such as hand tools) including electrical connectors according to this invention may thus often exhibit improved reliability. Moreover, it will be appreciated that connecting and disconnecting exemplary connector embodiments of this invention is relatively quick and easy. The use of springs, as described in more detail below (rather than threads or clips as are known in prior art connectors), enables a connection to be made by simply urging the upper 302 and lower 310 portions together. Furthermore, such connector embodiments cannot be partially connected. Rather the connector is either fully connected or fully disconnected, and therefore gives no false sense of being connected. This latter feature makes these embodiments particularly well suited to aircraft and other applications demanding a particularly high level of reliability.

With reference again to FIG. 1, one exemplary embodiment of electrical connector 300 is described in more detail. In the embodiment shown, the upper portion 302 of connector 300 includes first 304 and second 306 substantially cylindrical shrouds that are sized and shaped to cover the internal components of the connector 300. As described in more detail hereinbelow, shroud 304 is deployed to remain substantially stationary with respect to upper portion 302. Shroud 306, on the other hand, is disposed to reciprocate longitudinally along axis 501 and is biased towards the lower portion 310 by an axial spring 356 (shown on FIG. 7A). In the exemplary embodiment shown, shroud 306 includes a plurality of splines 352 (shown on FIG. 4) disposed on an inner surface thereof. With additional reference to FIG. 3, splines 352 engage upper slots 338 formed in an upper lock 312 of upper connector portion 302. Such engagement substantially prevents relative rotation between shroud 306 and lock 312 about axis 501. The artisan of ordinary skill will readily recognize that pins, for example extending through shroud 306, may be substituted for splines 352 without departing from the invention. Moreover, although the splines and slots are shown extending axially, the skilled artisan should recognize that they may be oriented in other directions, e.g., helically, without departing from the spirit and scope of the invention. For example, the splines and slots may form a helix which spirals in a direction opposite that of the teeth to securely maintain engagement thereof. With reference again to FIG. 1, the upper 302 and lower 310 portions may also include reliefs 308 and 357 (typically fabricated from a relatively soft material) that enable the power cords 504 and 506 to flex laterally (i.e., in a direction transverse to axis 501).

Turning now to FIGS. 2 through 5, one exemplary embodiment of connector assembly 300 is shown in connected (FIG. 2) and disconnected (FIGS. 3 through 5) configurations. For clarity, shroud portions 304 and 306 (which prevent connector 300 from unlocking), shown on FIG. 1, are removed on FIGS. 2 and 3. With further reference to FIGS. 7A through 7D, the structure and function of connector assembly 300 will now be described in more detail by describing connection of the upper 302 and lower 310 connector portions. Disconnection of the connector assembly 300 is described in more detail hereinbelow with respect to FIGS. 8A through 8D. Connector assembly 300 may be connected, for example, by simply aligning polarity alignment keyways 354 and 356 with tabs 344 and 346 and then urging upper and lower portions 302 and 310 together along axis 501 as shown at 375 on FIG. 7A. It will be appreciated that in exemplary embodiments in which polarity alignment is advantageous a single keyway and tab may be utilized. It will be understood, however, that this invention is not limited to the use of polarity alignment keyways 354 and 356 and tabs 344 and 346.

Figure 5:
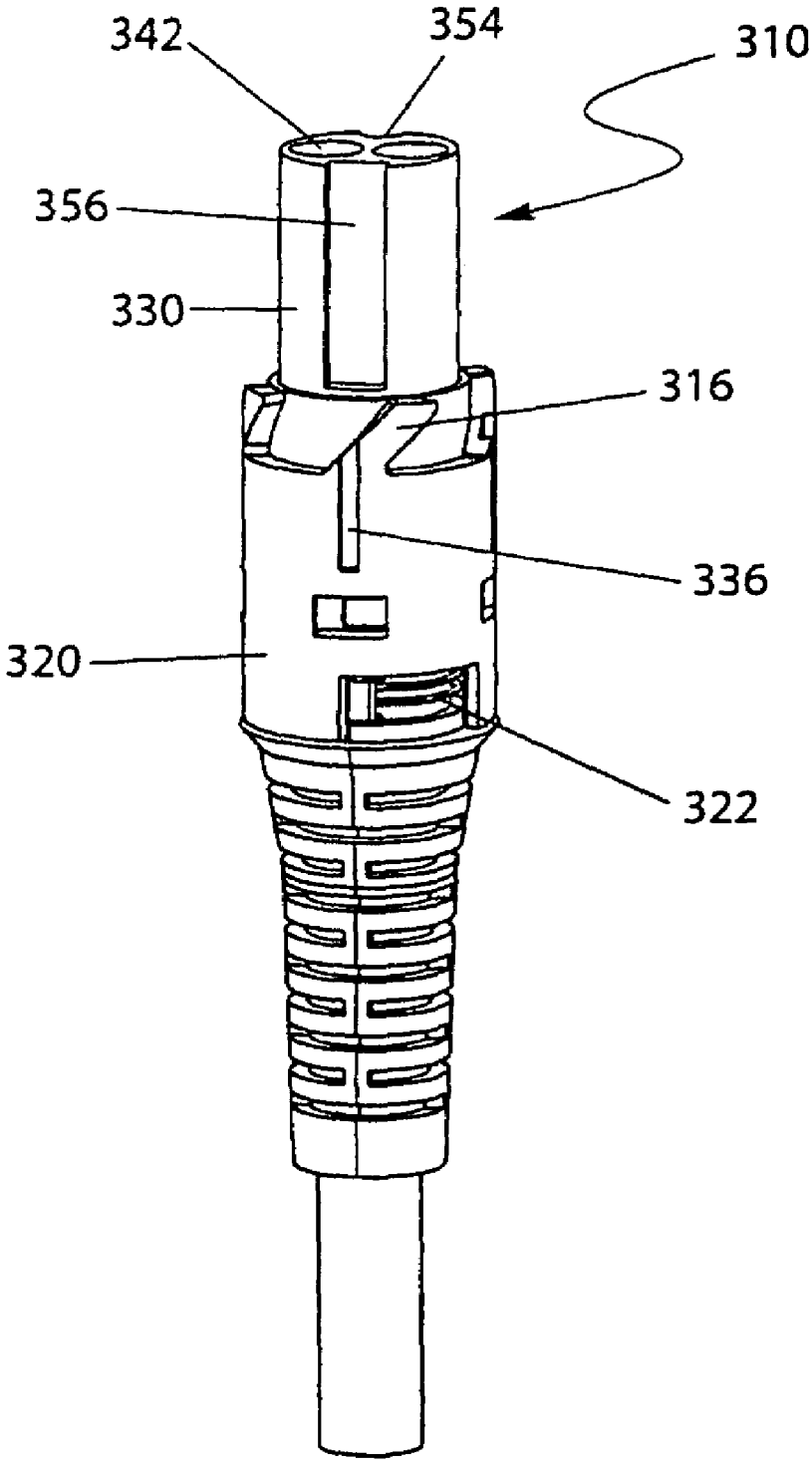
FIG. 5 is a perspective view of a lower portion of the connector assembly of FIG. 1.
Figure 6:
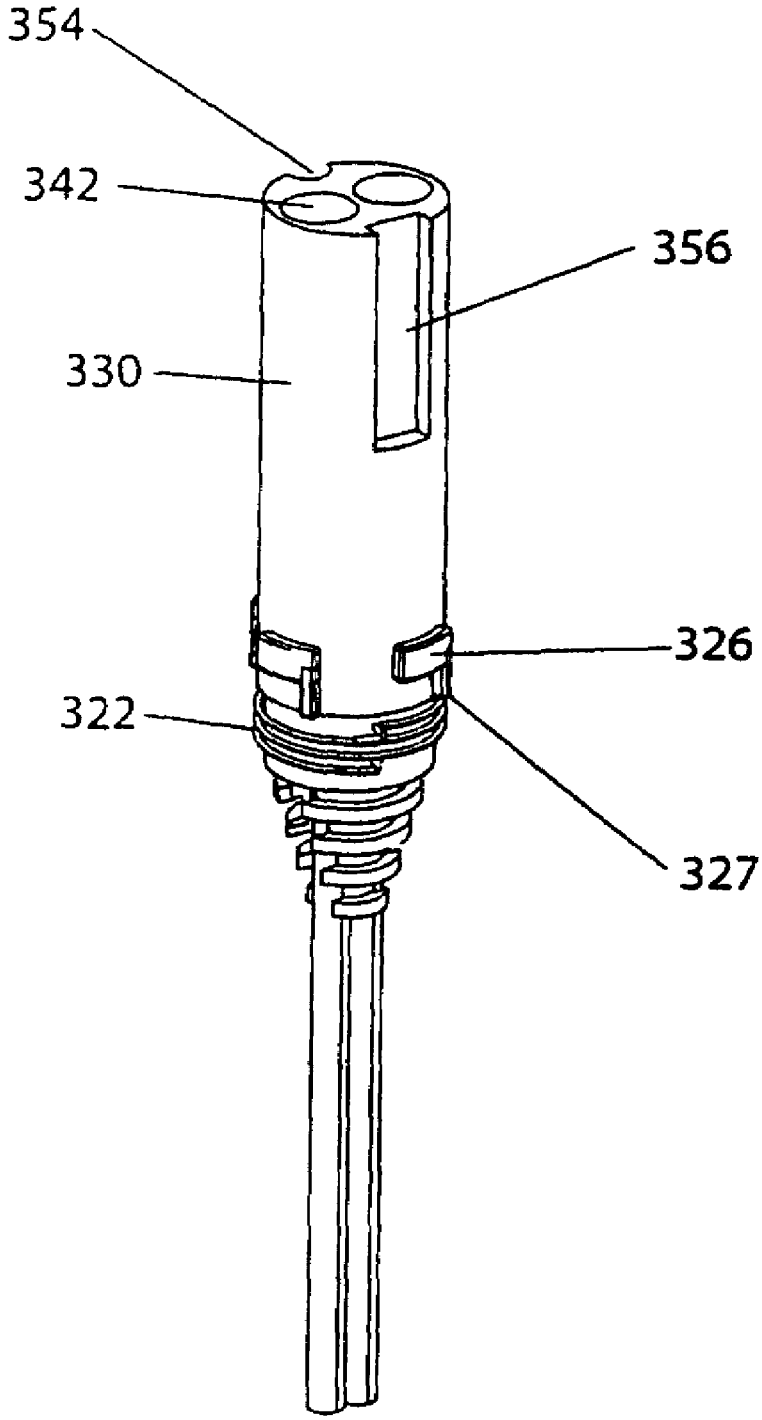
FIG. 6 is a perspective view of a inner component of the lower portion of FIG. 5.
Figure 7A:
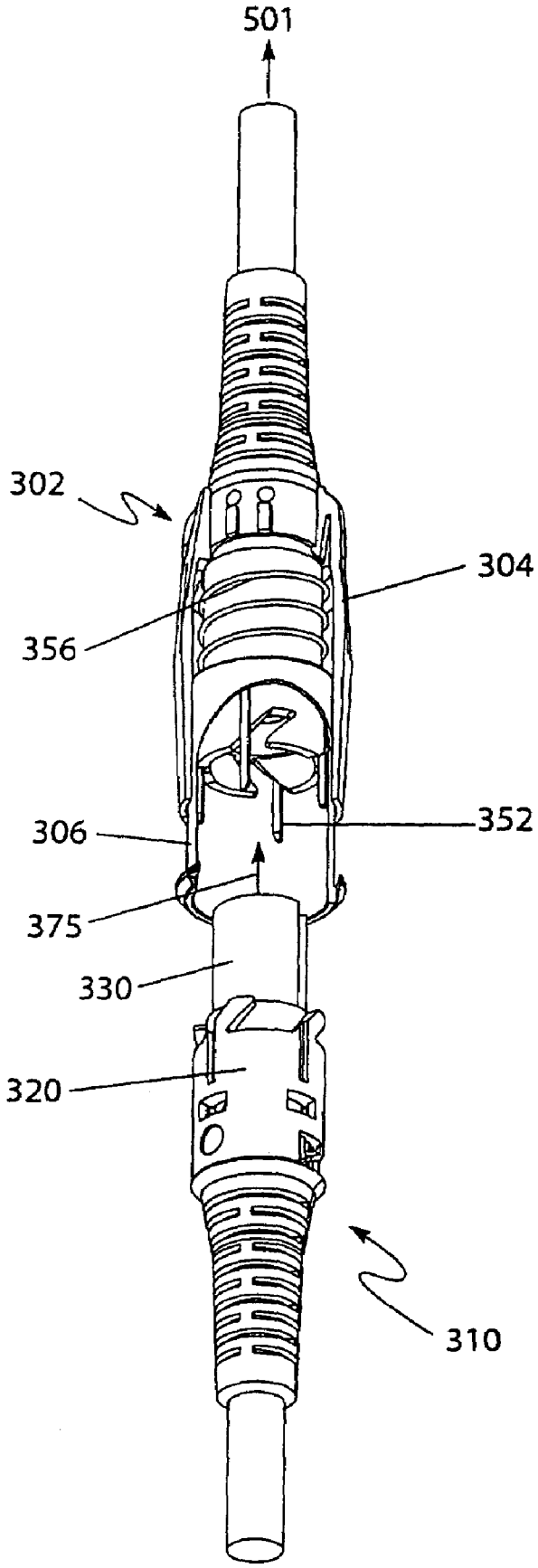
FIGS. 7A through 7D are cut away views illustrating connection of the connector assembly of FIG. 1.
Figure 7B:
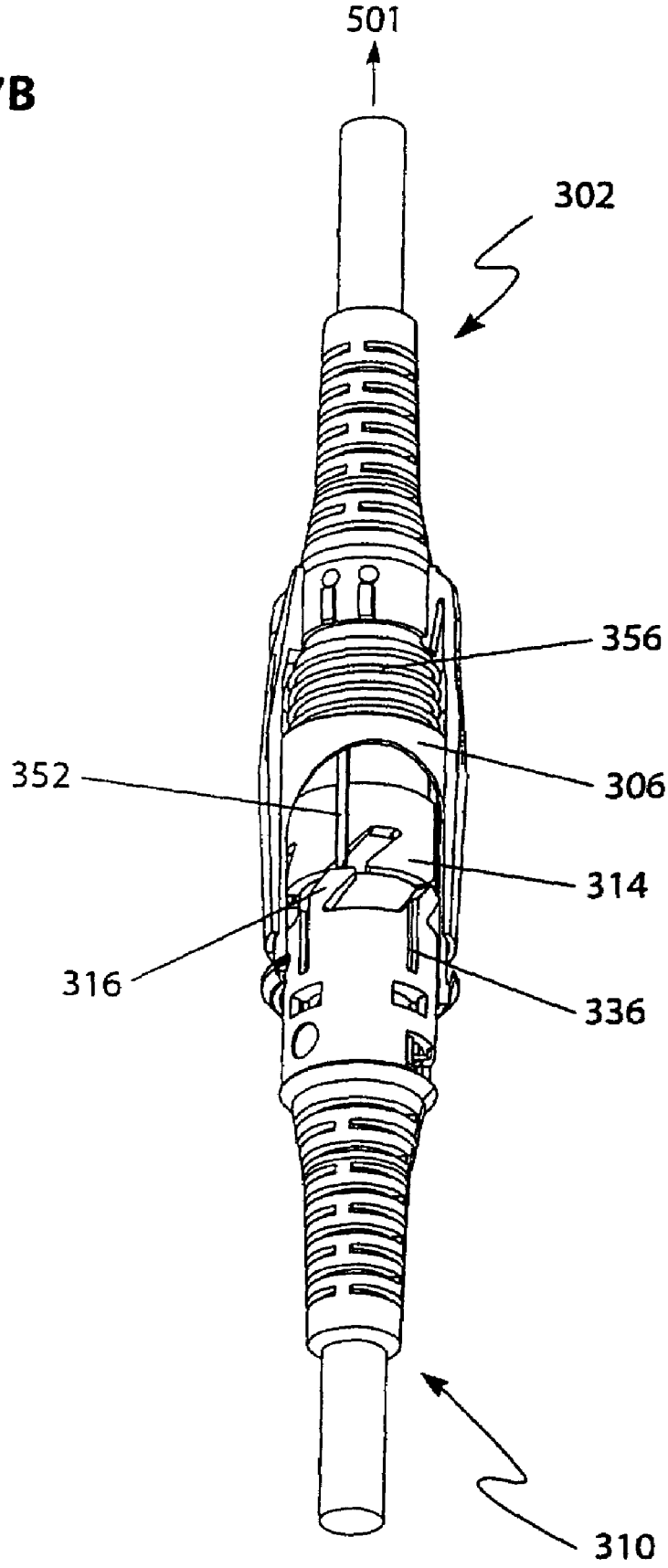
Figure 7C:
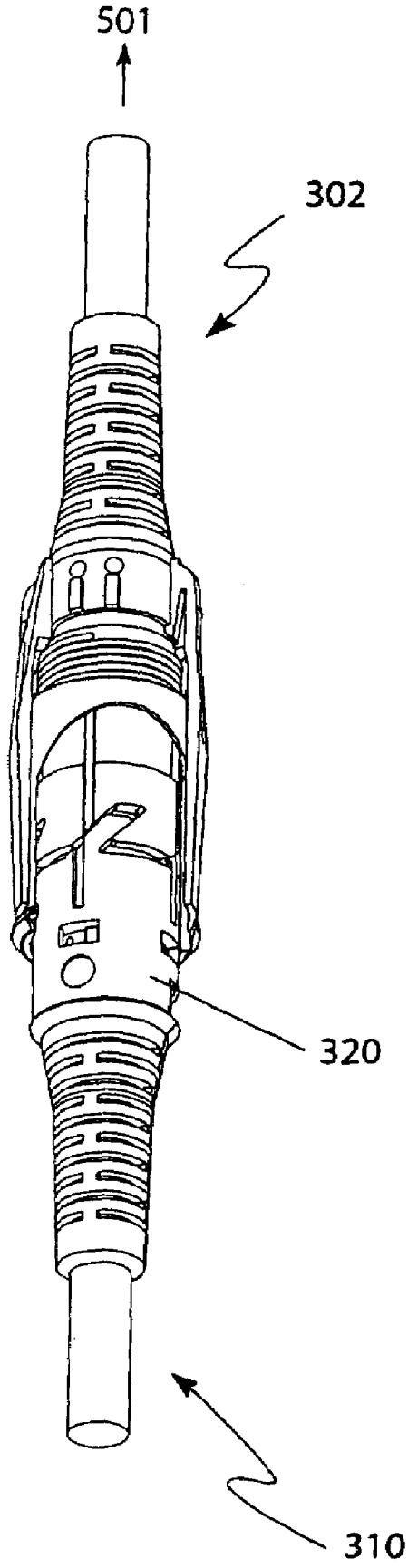
Figure 7D:
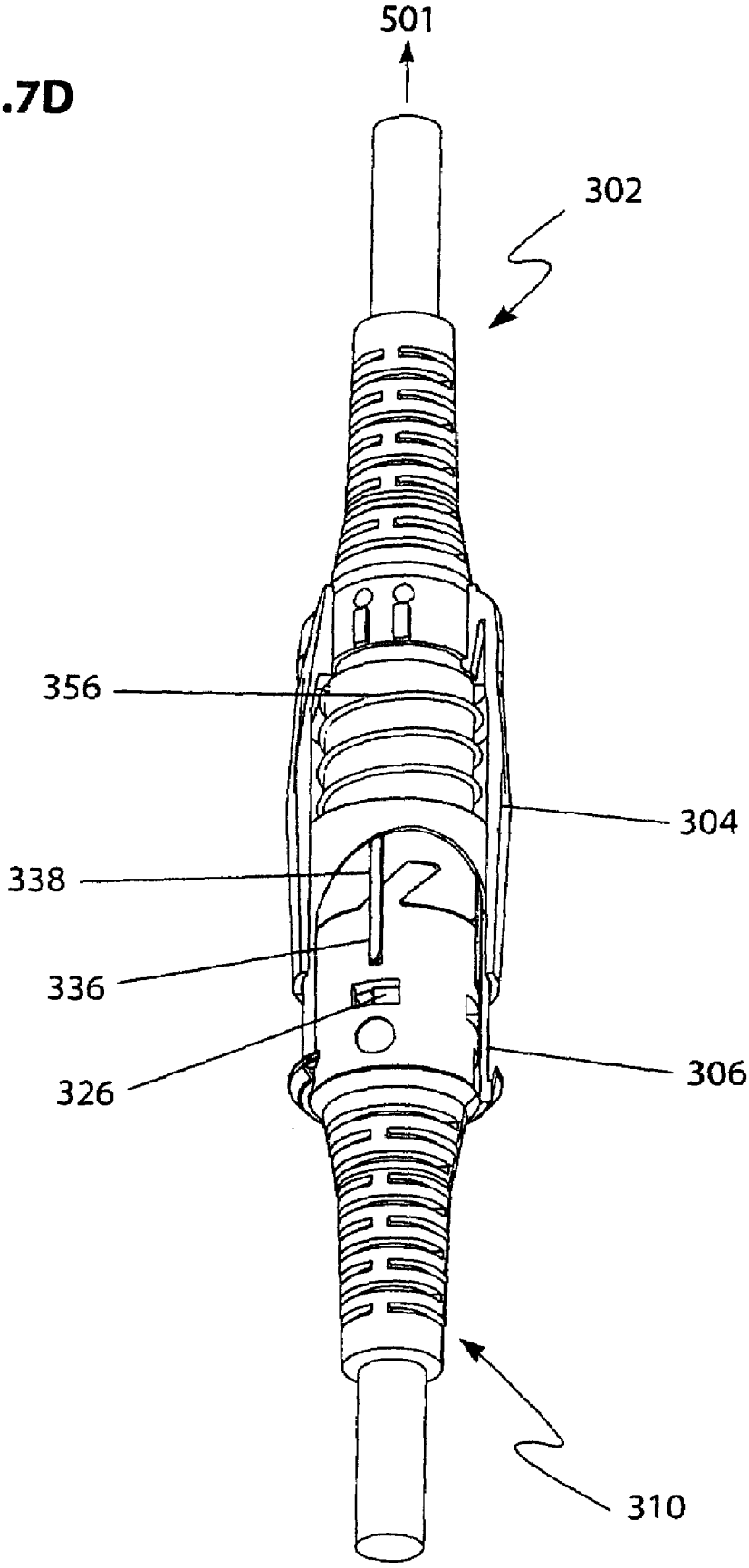
Figure 8A:
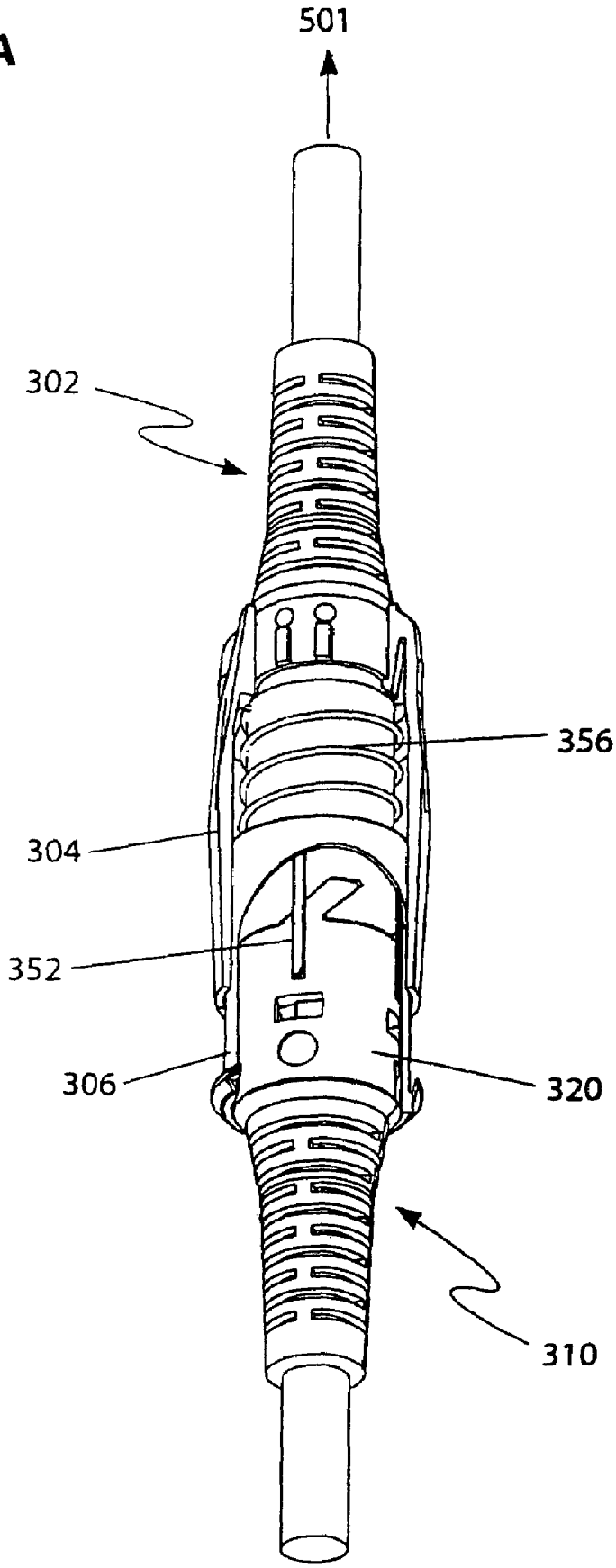
FIGS. 8A through 8D are cut away views illustrating disconnection of the connector assembly of FIG. 1.
Figure 8B:
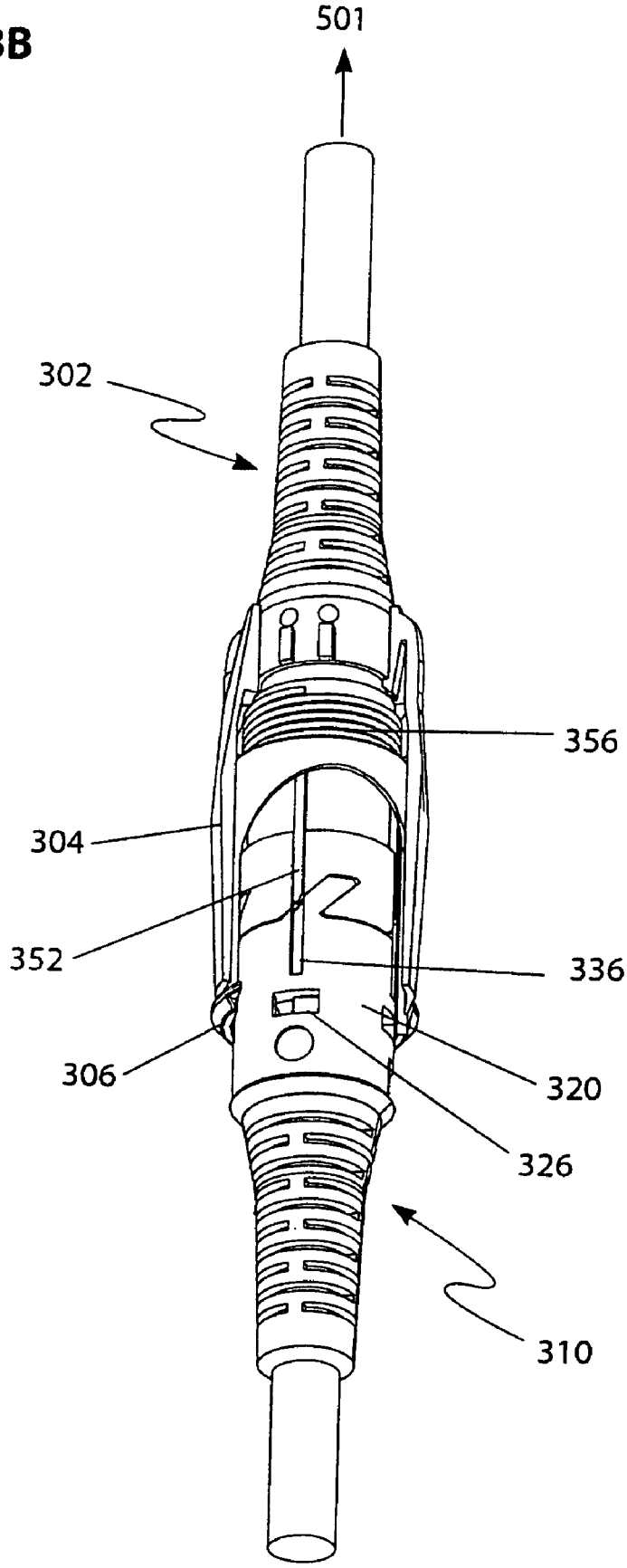
Figure 8C:
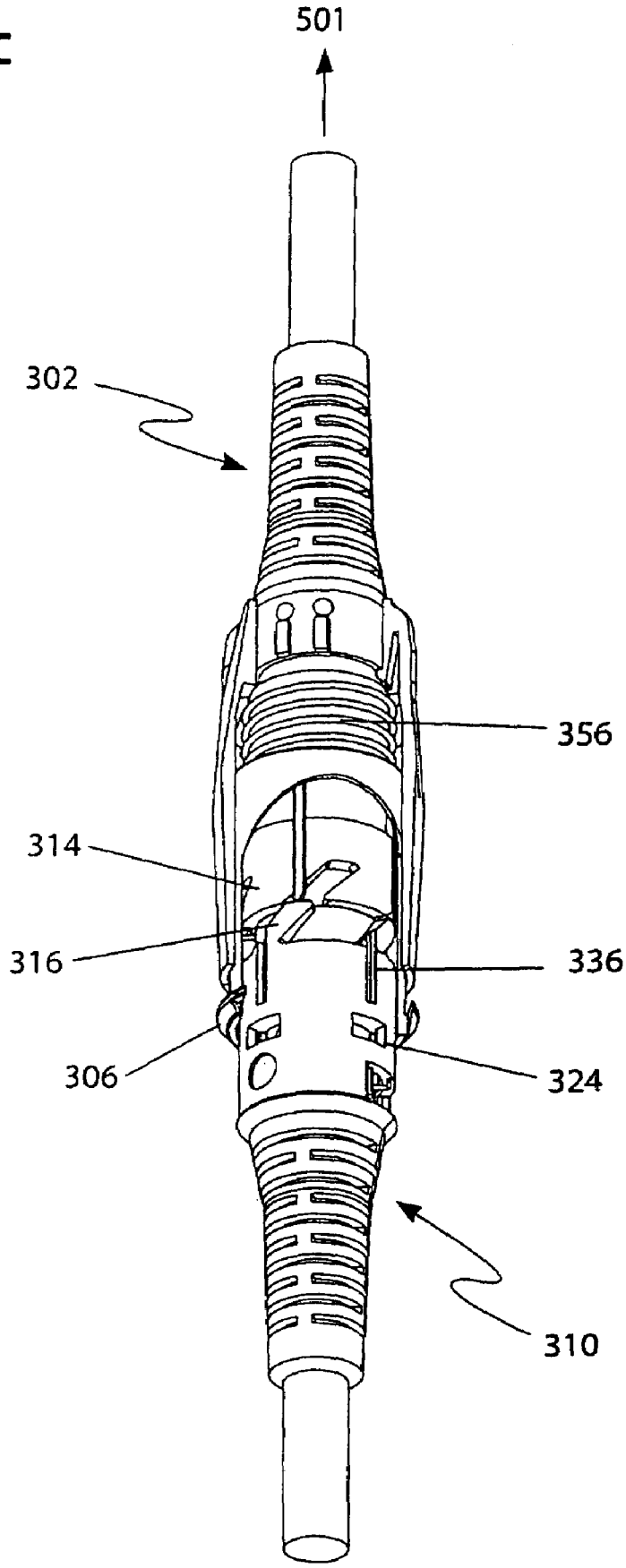
Figure 8D:
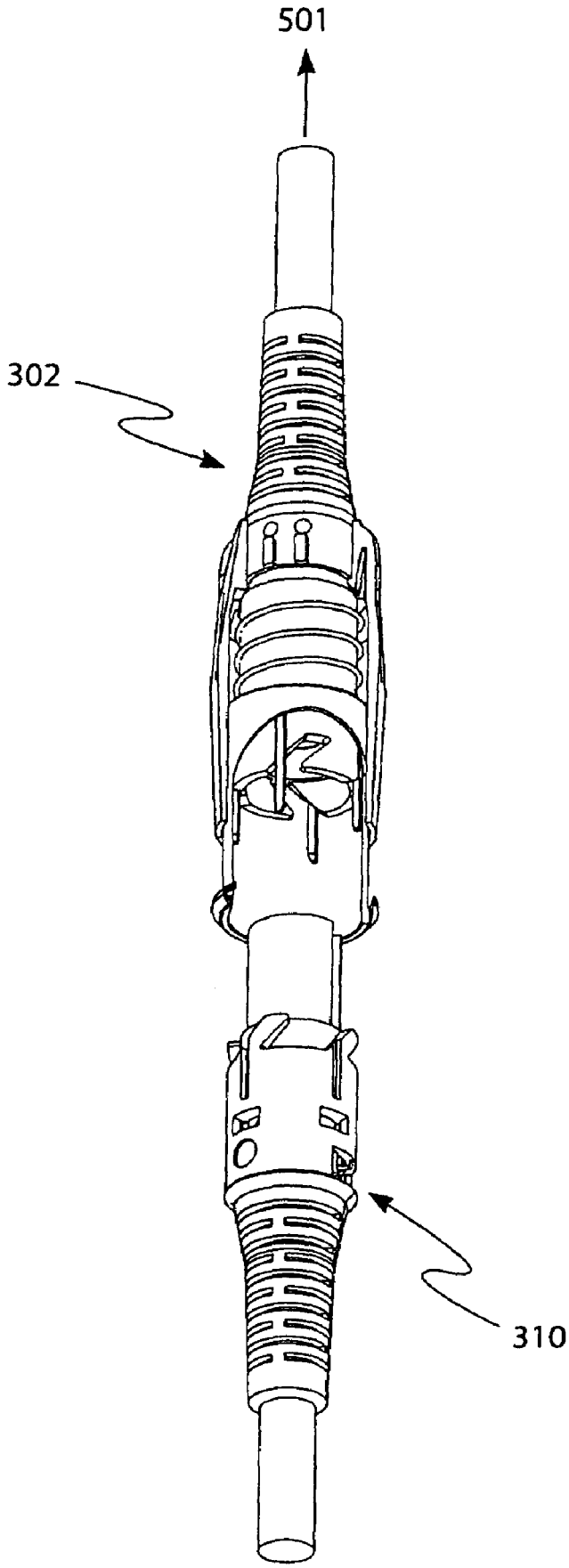

Upper and lower portions 302 and 310 each include a plurality of locking teeth 314 and 316 sized and shaped for engagement with one another. When the upper portion 302 is aligned with and moved into engagement with the lower portion 310 along axis 501 (or likewise when the lower portion 310 is aligned with and moved into engagement with the upper portion 302), locking teeth 316 contact splines 352. Continued axial movement of upper 302 and lower 310 portions into engagement with one another urges shroud 306 upwards against the bias of spring 356 until locking teeth 314 and 316 begin to engage one another as shown on FIG. 7B so that splines 352 begin to slide down the shoulder of locking tooth 316 (FIGS. 7B and 7C). As shown on FIG. 7C, locking teeth 314 and 316 engage one another to rotationally cam cylindrical lower lock 320 about axis 501 against the bias of torsion spring 322 (FIGS. 5 and 6). Such camming action continues while the upper 302 and lower 310 portions are urged together along axis 501 until the upper teeth 314 and lower teeth 316 are fully engaged in interdigitated orientation with one another as shown on FIGS. 2 and 7D. Upon full engagement the cylindrical upper lock 312 and lower lock 320 are locked one to another and prevented from unlocking by the full engagement of splines 352 with the upper slots 338 and the lower slots 336.

It will be appreciated that embodiments of this invention may include substantially any number of upper 314 and lower teeth 316 having substantially any size relative to the other connector components. The invention is not limited in this regard. The artisan of ordinary skill will also recognize that steep (e.g., multiple start) threads may be used in place of teeth 314 and 316. Such steep threads typically extend at a pitch sufficient to provide full engagement with less than one revolution, and preferably less than one-quarter of one revolution, of upper lock 312 relative to lower lock 320 to promote quick and easy operation.

The above described camming action also serves to rotate lower lock 320 about axis 501 such that one or more tabs 324 on lower lock 320 become engaged with abutments 326 and 327 (shown on FIG. 6) deployed on an inner component 330 of lower portion 310. It will be appreciated that lower lock 320 is thus deployed on the inner component 330 in a manner that enables rotation thereof about axis 501 but prevents translation along axis 501 once the upper and lower locks are fully engaged. As shown, the engagement of the tabs 324 and abutments 326 locks or captures the lower lock 320 to inner component 330, thereby inhibiting axial separation upon full engagement of the locks. In this fully engaged position, tabs 324 may also be engaged with abutments 327. Tabs 324 are similarly engaged (albeit on the opposite sides thereof) with abutments 327 when locks 312 and 320 are disengaged, i.e., when lower lock 320 is rotated with the bias of spring 322. In this manner, abutments 327 serve as stops which effectively prevent lower lock 320 from over-rotating in either rotational direction. Moreover, abutments 327 are positioned so that once polarity tabs (e.g., 356 and 346 of FIGS. 4 and 6) are engaged, upper and lower teeth 314 and 316 are properly aligned to facilitate their mutual engagement as shown in FIG. 7B.

Once the upper 314 and lower 316 teeth are fully engaged, slots 336 and 338 are aligned along axis 501. Such alignment enables the lower shroud 306 (FIG. 1) to be biased towards the lower portion 310 of the connector assembly 300 by axial spring 356 such that splines 352 engage slots 336 (as shown on FIG. 7D). The mutual engagement of the splines 352 and aligned slots 336 and 338 substantially prevents lower lock 320 from counter rotating about axis 501, e.g., due to the bias of torsion spring 322 and any axial forces on the connector. As such, disengagement of the upper and lower 302 and 310 portions is substantially prevented.

With continued reference to FIGS. 2 through 5, connection of upper portion 302 and lower portion 310 serves to electrically couple male pins (deployed in holes 342 shown on FIGS. 5 and 6) with female receptacles 340 (shown on FIG. 4) and thereby provides electrical communication between hand tool 502 and support 510. In the exemplary embodiment shown, connector assembly 300 is configured to selectively electrically connect and disconnect a hand tool (such as a hair dryer) from a 110 or 220 VAC power source. Moreover, the embodiment shown includes two pins and two corresponding receptacles 340 for coupling "hot" and "neutral" lines of a 110/220 VAC power supply. It will be appreciated that alternative embodiments of connector assembly 300 may include substantially any number and type of pins and sockets, for example for interconnecting a plurality of data and/or power transmission lines, such as, for example, a conventional network bus connector and it is thus not limited to 110/220 VAC. Moreover, as shown, receptacles 340 may be disposed within cylindrical columns 341 sized and shaped for receipt within holes 342. The skilled artisan will recognize that this construction advantageously provides a relatively large degree of insulative separation between adjacent electrical conductors (pins), to help prevent sparks from jumping therebetween. This separation may be useful in achieving certification by various organizations such as Underwriters Laboratories.

With reference now to FIGS. 8A through 8D, disconnection of connector assembly 300 is described in more detail. To disconnect the upper 302 and lower 310 portions of connector assembly 300 a user simply urges shroud 306 upwards against the bias of spring 356, thereby retracting it relative to shroud 304 as shown on FIG. 8B. As also shown on FIG. 8B, such action moves splines 352 clear of lower slots 336 and lower teeth 316, which in turn, allows lower lock 320 to counter rotate under the bias of torsion spring 322 and an axial force exerted by the user or the weight of the tool (FIGS. 5 and 6). The rotation of lower lock 320 enables lower teeth 316 to disengage upper teeth 314. The upper 302 and lower 310 portions may then be separated from one another as shown on FIG. 8D.

It will be appreciated that exemplary embodiments of connector assembly 300 may advantageously support substantial axial loads (such as the weight of a hand tool electrically coupled thereto or the force of an operator pulling on the hand tool during use thereof). Referring again to FIGS. 2 through 5, when the upper 302 and lower 310 portions of the connector assembly 300 are connected, such axial loads are supported by the engaged upper 314 and lower 316 teeth. In order to disengage the teeth 314 and 316, one set must be rotated relative to the other (e.g., by rotating lower lock 320 relative to upper lock 312). Such rotation, however, is substantially prevented by the engagement of splines 352 with slots 336 and by the engagement of abutments 326 with lower lock 320 as described above.

It will also be appreciated that exemplary embodiments of connector assembly 300 do not include a partial or intermediate connected state. Rather, the upper 302 and lower 310 portions are advantageously either fully connected or fully disconnected, thereby substantially preventing a user from inadvertently partially connecting the connector, for example, by confusing a false sense of connectedness with an actual physical connection. Such functionality is ensured by the action of springs 322 and 356. Unless the upper 302 and lower 310 portions are fully connected with splines 352 fully engaged with slots 336, torsion spring 322 counter rotates lower lock 320, which disengages upper 314 and lower 316 teeth as described above. Once fully connected, however, axial spring 356 biases splines 352 into engagement with slots 336, thereby ensuring that the connector assembly remains locked in the connected configuration until it is intentionally disconnected.

Figure 9:
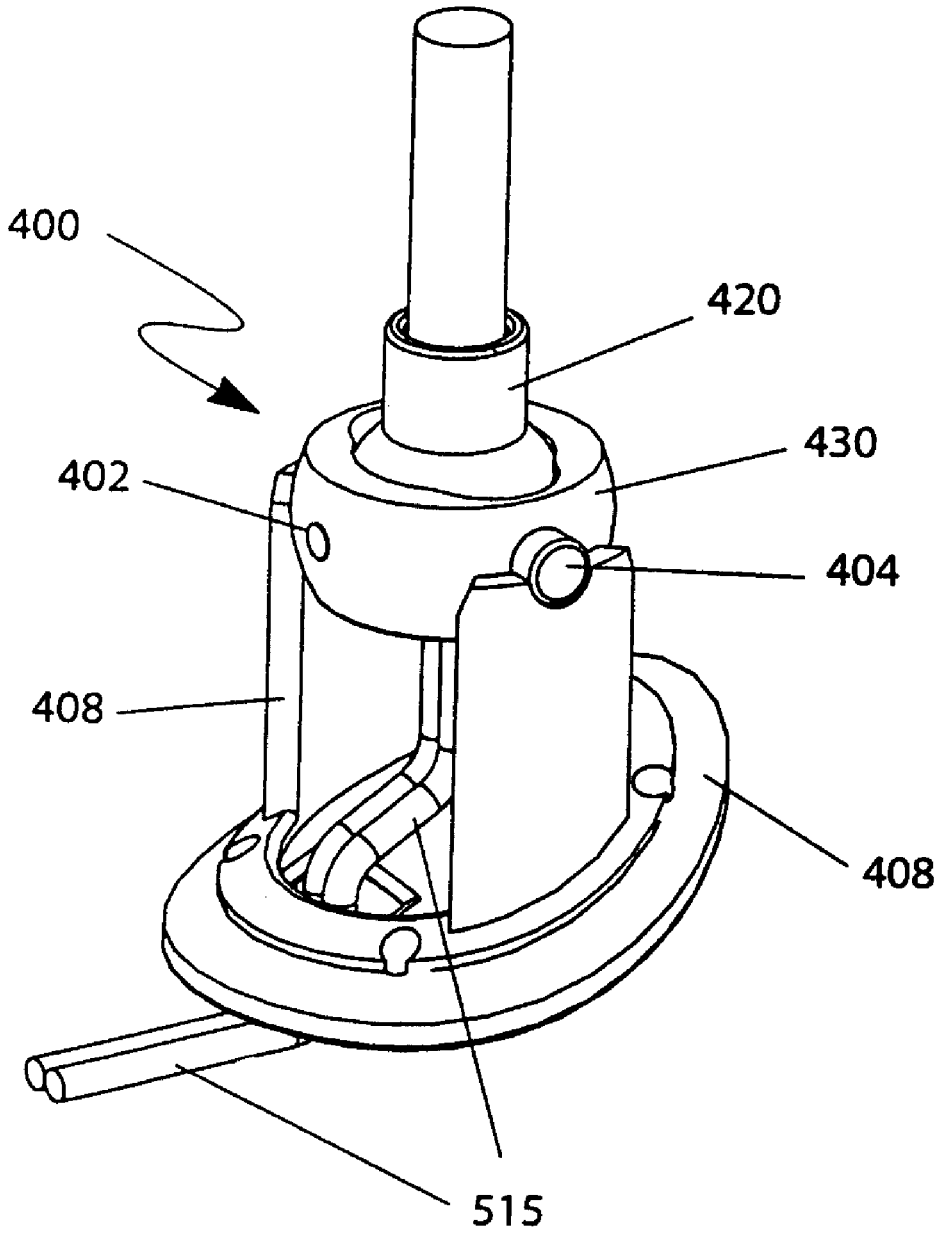
FIG. 9 is a perspective view of the gimbal assembly of FIG. 1 with the outer housing removed.

With reference now to FIG. 9, in which outer housing 410 has been removed for clarity, one exemplary embodiment of gimbal assembly 400 (FIG. 1) is described in more detail. Gimbal assembly 400 includes a gimbal 430 deployed about a receptacle, which in the embodiment shown includes a substantially spherical ball 420, which may optionally, as shown, include an elongated neck portion through which cord 504 (FIG. 1) may extend. Gimbal 430 is disposed to rotate about receptacle 420 and a first axle 402, which extends through receptacle 420. The receptacle 420 and gimbal 430 are disposed to rotate together about a second axle 404, which is supported by, and captured between, an internal housing 408 and an external housing 409 (FIG. 1) engaged therewith. Housings 408 and 409 are typically mechanically coupled (e.g., screwed or riveted) to one another and/or to hand tool 502 (FIG. 1).

Figure 10:
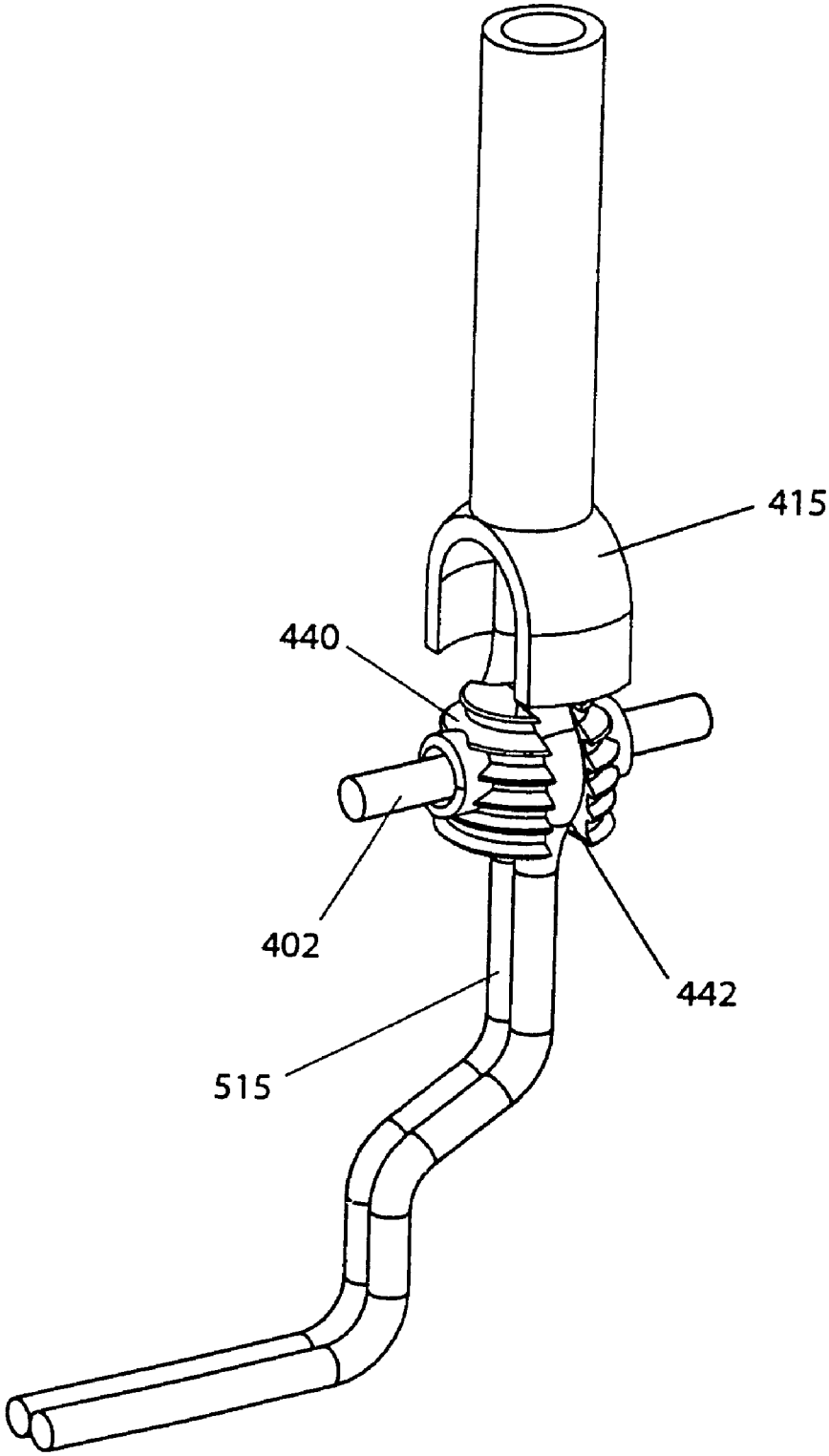
FIG. 10 is a partially exploded view of an interior portion of the gimbal assembly of FIG. 1.
Figure 11:
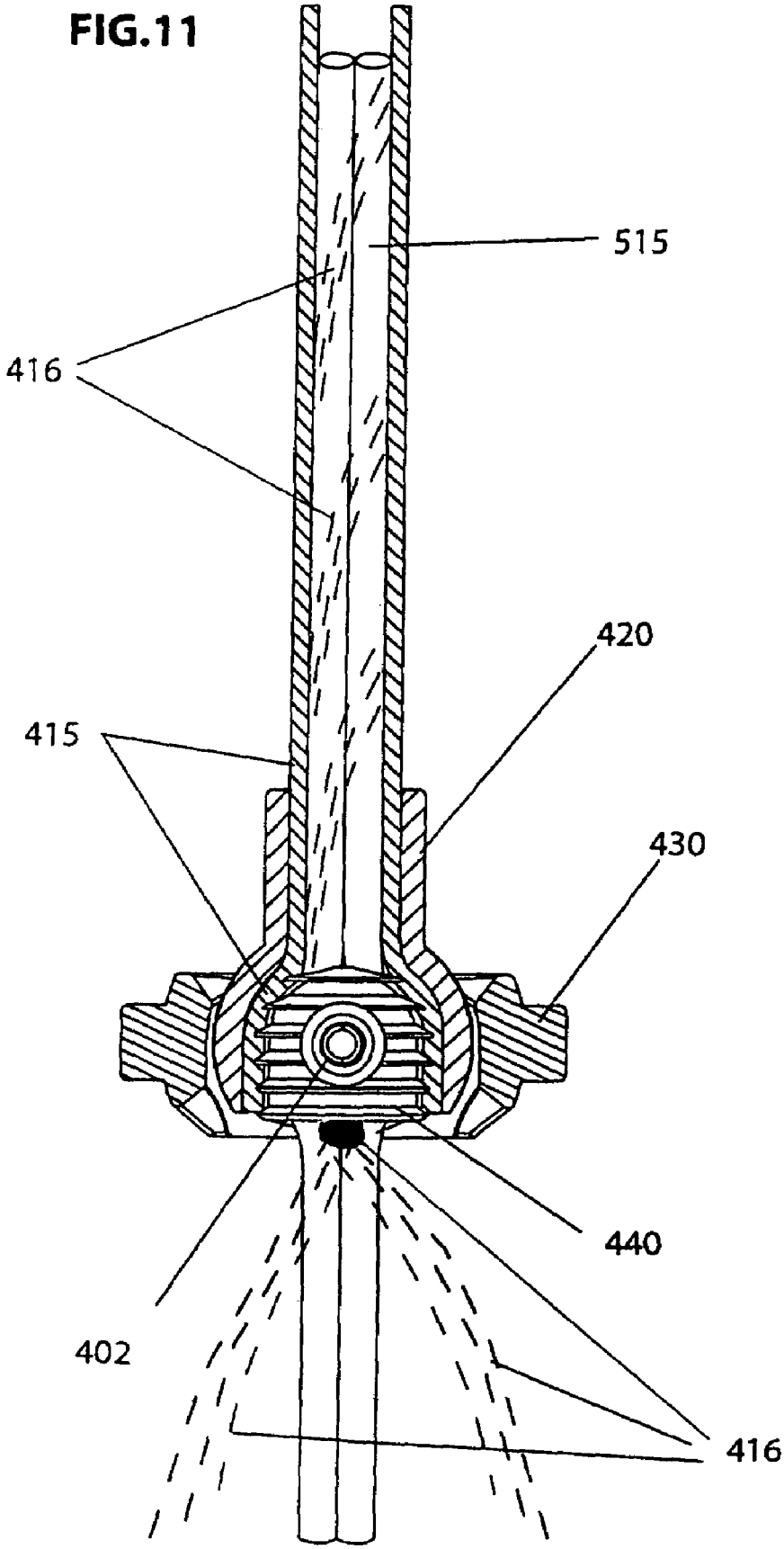
FIG. 11 is a cross sectional view of the gimbal assembly of FIG. 1.

With reference now to FIGS. 10 and 11, and continued reference to FIG. 9, electrical wires 515 extend through the gimbal assembly, for example from hand tool 502 to a power source located in support 510 (FIG. 1). Electrical wires 515 are tightly secured in wire channels 442 of internal wedge 440 to substantially prevent the electrical wires 515 from being pulled through the gimbal assembly 400 along axis 501. As shown on FIG. 22, electrical wires 515 straddle or otherwise bypass first axle 402, which extends through the inner wedge 440. Cable jacket 415 is deployed about internal wedge 440 and protects electrical wires 515 from mechanical damage. In one suitable embodiment, cable jacket 415 includes a high strength fiber material 416 such as a Kevlar® aramid fiber (E.I. du Pont de Nemours and Company, Wilmington, Del.). Such fibers 416 may extend along the longitudinal axis of the jacket 415, e.g., in a direction substantially parallel or helical relative to conductors 515. In one optional embodiment as shown, the fibers 416 are tied together below axle 402 and provide additional axial strength to the gimbal assembly 400. As shown on FIG. 11, receptacle 420 may be press fit about cable jacket 415, causing rib portions 444 of internal wedge 440 to securely engage an internal surface of the cable jacket 415, e.g., by slight penetration therein. Such engagement of rib portions 444 with cable jacket 415 secures the electrical wires 515 in the gimbal assembly and substantially prevents them from being pulled therethrough. It will be appreciated that in alternative embodiments wires 515 and jacket 415 may be molded into the spherical receptacle 420 using techniques such as injection molding and/or casting molding. It will also be appreciated that while gimbal assembly 400 is shown in use with a handheld tool such as hair dryer 502 (FIG. 1), exemplary embodiments of gimbal assembly 400 may advantageously support axial loads in excess of 100 pounds (45 kilograms).

Although the connector and gimble embodiments have been described herein as being electrical devices, it should be recognized by those skilled in the art that they may be adapted to non-electrical uses, such as, for example, air or gas lines, without departing from the spirit and scope of the present invention. Moreover, the connector and/or gimble embodiments may be used in substantially any application in which quick and accurate connection of two components is required.

Furthermore, although the embodiments shown and describe relate to in-line connectors, the skilled artisan should recognize that these embodiments may be adapted to panel-mounted applications while remaining within the scope of this invention.

In the preceding specification, the invention has been described with reference to specific exemplary embodiments thereof. It will be evident that various modifications and changes may be made thereunto without departing from the broader spirit and scope of the invention as set forth in the claims that follow. The specification and drawings are accordingly to be regarded in an illustrative rather than restrictive sense.

What is claimed is:

1. A gimbal assembly for use with a power tool wherein an electric power cord including first and second electric lines extends through the gimbal assembly, the gimbal assembly comprising:

a gimbal deployed about a receptacle, the gimbal disposed to rotate about a first axle, the first axle extending through the gimbal and the receptacle, the gimbal and the receptacle disposed to rotate together about a second axle, the second axle substantially orthogonal to the first axle, the second axle supported by an internal housing;

a wedge deployed in the receptacle, the wedge including first and second wire channels, the first and second wire channels disposed to receive the corresponding first and second electric lines wherein the first and second electric lines bypass the first axle; and a cable jacket deployed about the wedge, wherein the cable jacket is secured between the receptacle and the wedge to resist axial movement of the cable.

2. The gimbal assembly of claim 1, wherein the cable jacket includes a fiber material extending along the length thereof.

3. The gimbal assembly of claim 1 being coupled to a power tool.

4. The gimbal assembly of claim 1, wherein the first and second electric lines extend through the gimbal assembly in a direction substantially orthogonal to the first and second axles.

5. The gimbal assembly of claim 1, wherein the wedge comprises at least one protruding rib portion on an external surface thereof, the rib portion penetrating an inner surface of the cable jacket.

6. The gimbal assembly of claim 5, wherein said penetration of the at least one rib portion into the cable jacket substantially prevents the cord from being pulled through the gimbal assembly.

7. The gimbal assembly of claim 1, further comprising an outer housing deployed about the gimbal.

8. An electrical assembly comprising:

a first cord including a first connector portion coupled to one end thereof, the first connector portion including a first lock deployed about one or more first contacts;

a second cord including a second connector portion coupled to one end thereof, the second connector portion including a second lock deployed about one or more second contacts, the second lock configured to rotate about a longitudinal axis of the second connector portion between first and second rotational positions;

the first and second locks configured to engage and disengage one another upon connecting and disconnecting of the first and second connector portions, said engagement of the first and second locks operative to substantially prevent axial motion between the first and second connector portions;

a gimbal assembly deployed about one of the first and second cords; the one cord extending through the gimbal assembly, the gimbal assembly configured to permit rotation of a device coupled thereto about first and second substantially perpendicular axes;

the gimbal assembly including a wedge disposed within a receptacle, wherein a portion of the one cord is secured between the receptacle and the wedge; and the wedge includes a channel through which another portion of the cord extends.

* * * * *